US005142716A

United States Patent [19]

Ogle et al.

[11] Patent Number: 5,142,716

[45] Date of Patent: Sep. 1, 1992

[54] FOUNDATION UNIT WITH SNAP-FIT MODULAR SPRINGS

[75] Inventors: Steven E. Ogle; Danny L. Wylie, both of Carthage, Mo.

[73] Assignee: Leggett & Platt, Incorporated, Carthage, Mo.

[21] Appl. No.: 786,021

[22] Filed: Oct. 31, 1991

[51] Int. Cl.[5] ..... A47C 23/04; A47C 23/053

[52] U.S. Cl. ..... 5/247; 5/255; 5/260; 267/103

[58] Field of Search ..... 5/247, 255, 476, 263, 5/260, 267; 267/103

[56] References Cited

U.S. PATENT DOCUMENTS

| | | | |
|---|---|---|---|
| 3,833,948 | 9/1974 | Surletta et al. | 5/247 |
| 4,000,531 | 1/1977 | Imman | 5/267 |
| 4,068,329 | 1/1978 | Gross et al. | 5/255 |
| 4,828,233 | 5/1989 | Hagemeister | 5/248 |
| 4,838,528 | 6/1989 | Hagemeister | 5/255 |
| 5,005,809 | 4/1991 | Harmon | 5/247 |

*Primary Examiner*—Alexander Grosz
*Attorney, Agent, or Firm*—Wood, Herron & Evans

[57] ABSTRACT

A bedding foundation unit having a top planar portion defined by two pluralities of spaced parallel grid wires, and a rigid frame spaced apart from the top planar portion by a plurality of modular springs. The modular springs are connected to the top planar portion in a snap-fit manner, each snap-fit end of each modular spring being held in place by three grid wires above and one grid wire below the snap-fit end.

6 Claims, 3 Drawing Sheets

FOUNDATION UNIT WITH SNAP-FIT MODULAR SPRINGS

FIELD OF THE INVENTION

This invention relates to foundation units and, more particularly, to foundation units with modular springs having snap-fit connections.

BACKGROUND OF THE INVENTION

Foundation units are well known. Typical foundation units include a rigid frame and a top planar portion disposed above the frame by numerous spring elements. The top planar portion is typically defined by a welded wire grid. The spring elements are typically stapled to the wooden frame below and clipped, welded, or secured by other suitable means to the wire grid above. Typically a pad is placed over the top planar portion and the entire assembly is surrounded with a cover.

Foundation units which use modular springs for the spring elements are also known. For example, a modular spring and a foundation unit based on that modular spring are shown in U.S. Pat. No. 3,833,948, assigned to the assignee of the present invention, the disclosure of which is fully incorporated herein by reference. However, these modular springs are typically connected to the upper wire grid by clips, welding, or other means requiring special equipment and substantial labor. Consequently, the foundation unit cannot be manufactured as economically as desired.

Thus, it is desirable to be able to attach the modular springs to the planar top portion without requiring clips or welds etc. Several techniques for attaching the modular springs to the planar top portion without the use of clips or welds are shown, for example, in U.S. Pat. Nos. 4,828,233, 4,838,528, and 5,005,809. However, these patented techniques either require a series of complex bends to be made in relatively complex modular spring elements or require numerous grid wires and/or modules to make a satisfactory foundation.

It has therefore been an objective of this invention to provide an economical bedding foundation having modular springs secured to the grid wires of the top planar portion of foundation units, without the use of clips or welds.

SUMMARY OF THE INVENTION

The present invention achieves this objective by providing a simplified snap-fit connection between standard modular springs and the grid wires of the top planar portion.

In accordance with the principles of the present invention, the number of, the placement of, and the design of the grid wires of the top planar portion of a bedding foundation are modified to form a snap-fit connection between the modular springs and the grid wires.

More specifically, each modular spring used has a snap-fit section at its upper end. This snap-it end may be visualized as four bends in a piece of straight wire that form five coplanar segments: a centermost longitudinal section, two longitudinal end sections, each being parallel to but offset from the centermost longitudinal section, and being connected thereto with a transverse straight portion. The planar top portion of the foundation is defined by two pluralities of spaced parallel grid wires, each plurality lying perpendicular to the other. Each snap-fit section of each modular spring connects to four grid wires of the planar top portion as follows:

One grid wire from the first plurality of spaced parallel grid wires extends over both transverse straight portions of each modular spring. A second grid wire from the first plurality extends under both transverse straight portions. Finally, a pair of grid wires from the second plurality of spaced parallel grid wires extends over the longitudinal end sections in such a manner that one grid wire extends over each longitudinal end section. Thus, the snap-fit section of the modular springs are held in place by one grid wire extending under and three grid wires extending over the various segments of the snap-fit sections.

The advantage of a bedding foundation formed in this manner and having modules of this construction is that it provides a very economical foundation which may be easily and economically assembled without the use of any special tools.

These and other objects and advantages of the present invention shall become more readily apparent from the following detailed description taken in conjunction with the drawings herein, in which:

DETAILED DESCRIPTION OF THE PREFERRED EMBODIMENTS

Figure 1:
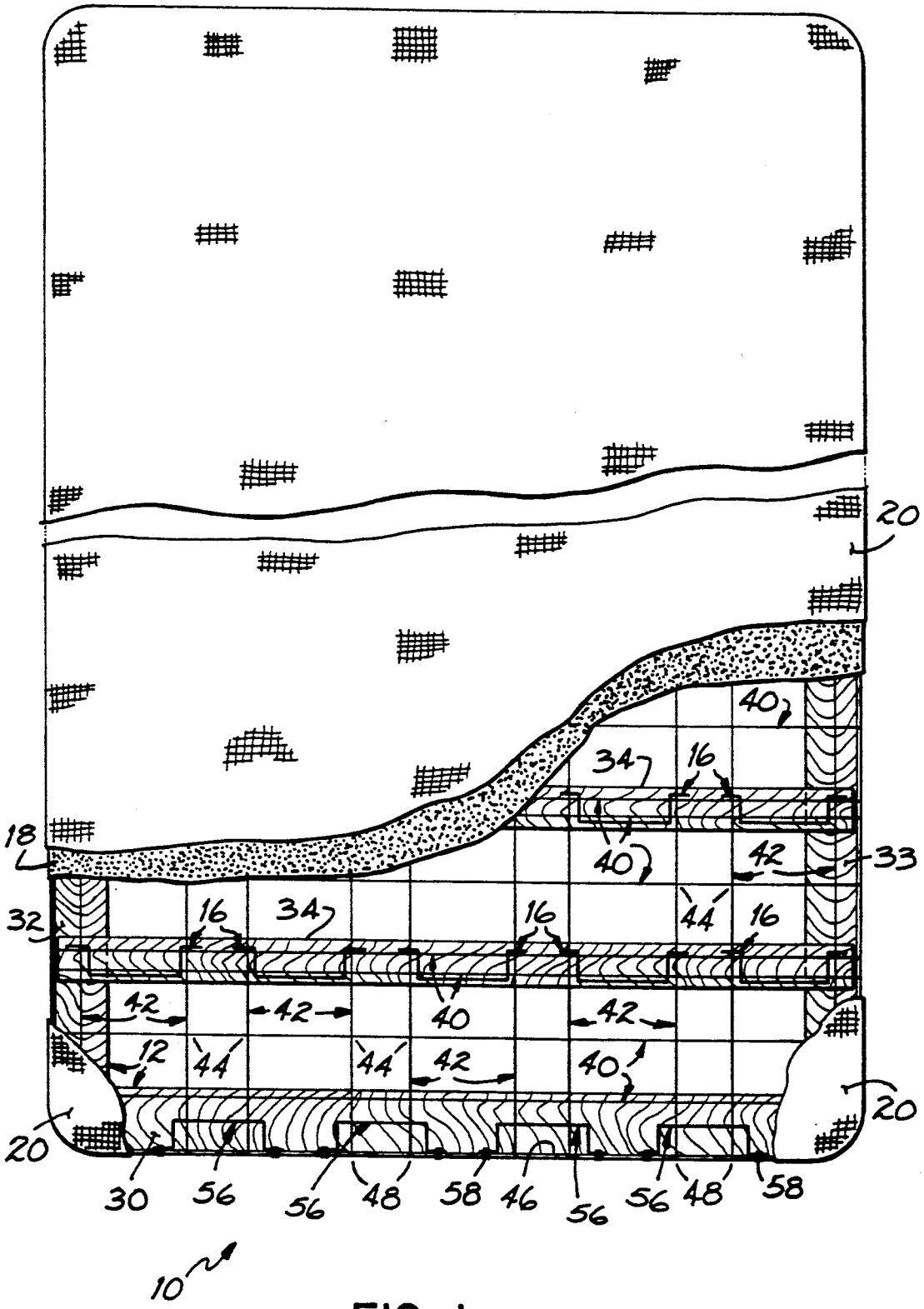
FIG. 1 is a top plan view, partially broken away, of a foundation unit incorporating the present invention.
Figure 2:
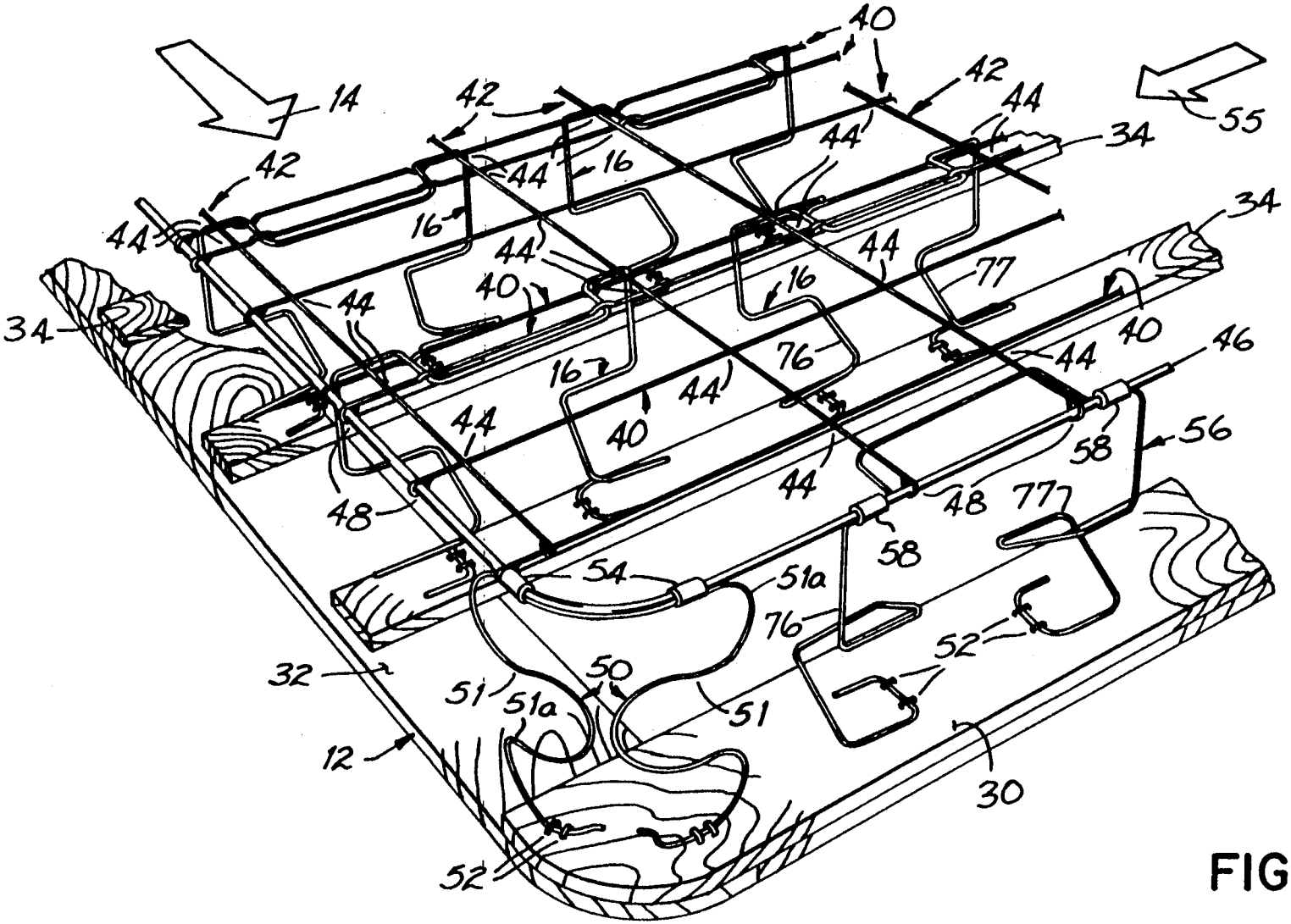
FIG. 2 is a perspective view of a corner portion of a bedding foundation unit incorporating the present invention with the pad and cover removed to expose the structure.
Figure 3:
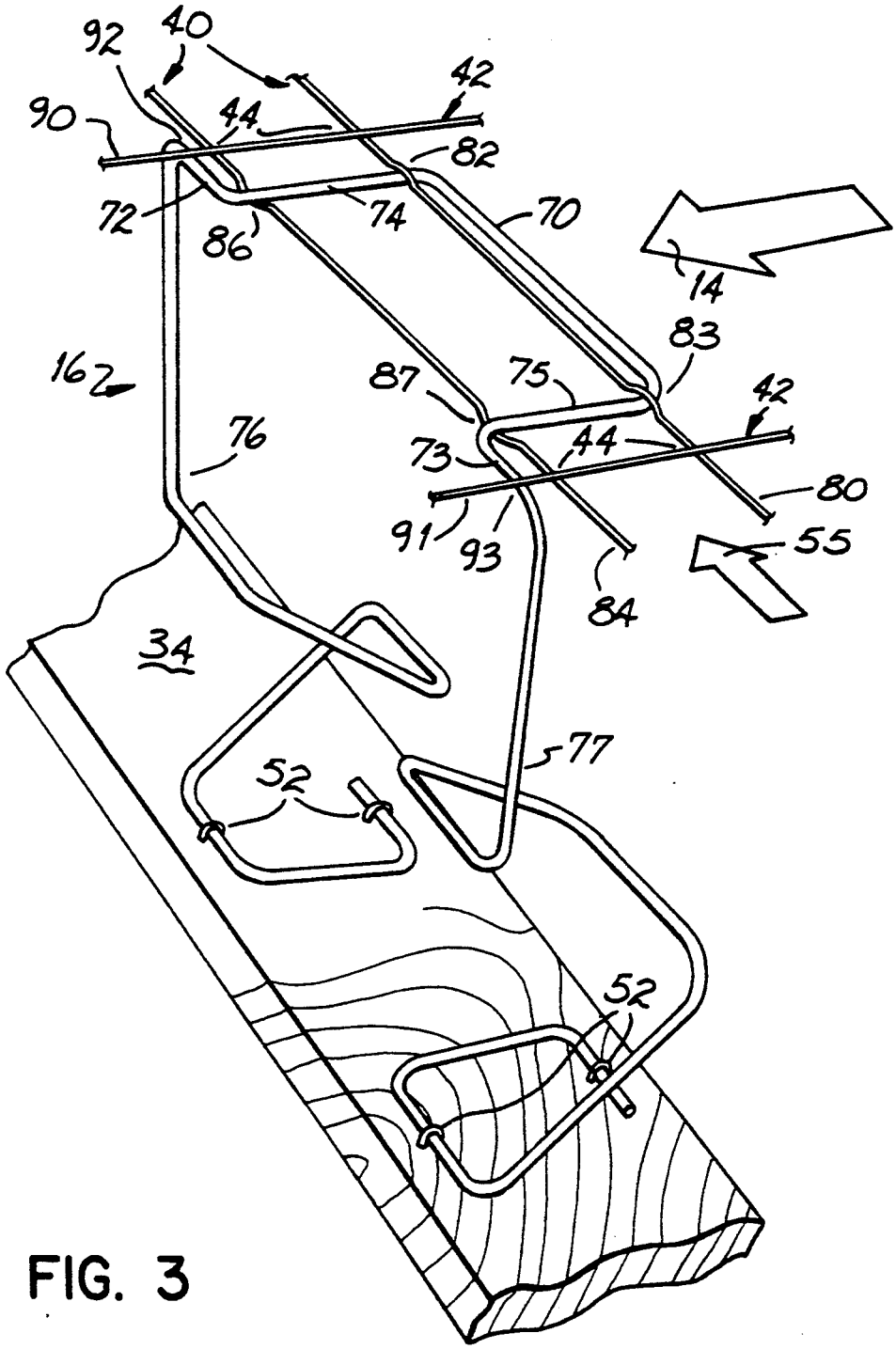
FIG. 3 is a perspective view of one modular spring showing the snap-fit connection of one spring module to the wire grid of the present invention.

With reference first to FIGS. 1-3, there is illustrated a foundation unit 10 employing the invention of the present application. This foundation unit comprises a frame 12, a planar top portion 14, and a plurality of modular springs 16. A pad 18 rests on the top surface of the planar top portion 14. An upholstered covering 20 encases the frame 12, the planar top portion 14, the plurality of modular springs 16, and the pad 18.

The frame 12 comprises two laterally displaced longitudinal frame members 32 and 33, two longitudinally displaced lateral frame members, with only lateral frame 30 shown in the figures, and a plurality of slats 34. These frame members and slats 34 are all secured by nails or other suitable means to provide a rigid frame 12 for the foundation unit.

The planar top portion 14 is defined by a first plurality of spaced parallel grid wires 40 and a second plurality of spaced parallel grid wires 42 lying perpendicular to and connected to the first plurality of grid wires 40. Individual grid wires 40 and 42 are interconnected by welds or other suitable means at the points at which they cross 44.

Referring now to FIG. 2, it may be seen that the boundary of the planar top portion 14 is defined by border wire 46. Grid wires 40 and 42 are connected to border wire 46 at 48 by welding or by wrapping (as shown in FIG. 2), or in the preferred embodiment by both wrapping and welding.

The frame 12 and the planar top portion 14 are spaced apart by a plurality of modular springs 16. There are two types of springs in three spring attachment configurations in the foundation unit.

In the first spring attachment configuration, a corner reinforcement spring 50 is connected at each corner of the foundation to the frame 12 by staples 52 and to border wire 46 by sheet metal clips 54. Between the border wire and the frame the corner reinforcement springs 50 each comprise a pair of vertical legs 51, each one of which comprises three interconnected sinuous loops 51*a*.

The second spring attachment configuration is that of modular springs 16 to slats 34 and planar top portion 14. Modular springs 16 comprise a planar top section 55 at their upper ends and two vertical leg sections 76 and 77 at their bases. Modular springs 16 are attached at the terminal ends of vertical leg sections 76 and 77 to the top surface of slats 34 by means of staples 52 or by other suitable means. The planar top sections 55 at the opposite ends of modular springs 16 are snap-fitted into the two pluralities of spaced parallel grid wires 40 and 42, which define the planar top portion 14. This snap-fit connection will be described in greater detail below.

The third and final spring attachment configuration refers to the attachment of peripheral modular springs 56 to longitudinal frame members 30 and 31 and border wire 46. Peripheral modular springs 56 are identical in structure to modular section springs 16, comprising a planar top section 55 and two vertical leg sections 76 and 77; the difference between modular springs 16 and peripheral modular springs 56 being the attachment methods at their upper ends. The terminal ends of vertical leg sections 76 and 77 of peripheral modular springs 56 are attached to longitudinal frame members 30 and 31 by staples 52 or by other suitable means. The upper end of peripheral modular springs 56, known as the planar top section 55, is connected to border wire 46 by clips 58.

Referring now to FIG. 3, the planar top section 55 of each modular spring 16 comprises five segments: a centermost longitudinal section 70; two coplanar longitudinal end sections 72 and 73, parallel to and coplanar with centermost longitudinal section 70; and two transverse straight portions 74 and 75, coplanar with and connected between centermost longitudinal section 70 and longitudinal end sections 72 and 73. This planar top section 55 of each modular spring 16 may best be thought of as four bends in a single wire forming the five coplanar segments 70, 72, 73, 74 and 75.

The planar top section 55 of each modular spring 16 connects to the grid wires 40 and 42 of coplanar top portion 14 as shown in FIG. 3. One grid wire 80 of the first plurality of spaced parallel grid wires 40 extends over transverse straight portions 74 and 75 at 82 and 83, respectively. A second grid wire 84 of the first plurality of spaced parallel grid wires 40 extends under transverse straight portions 74 and 75 at 86 and 87, respectively. Finally, wires 90 and 91 of the second plurality of spaced parallel grid wires 42 extend over longitudinal end sections 72 and 73, respectively, at 92 and 93. Thus, each snap-fit section of each modular spring 16 is held in place by four grid wires 80, 84, 90, and 91.

Preferably, each pair of grid wires 80 and 84 of the first plurality of spaced parallel grid wires 40 are crimped or detented where they cross the planar top sections of each modular spring 16 at 82, 83, 86, and 87. Each grid wire 80 is crimped upward at each cross point. Each grid wire 84 is crimped downward at each cross point. These crimps allow the planar top portion 14 to lie in substantially a plane defined by the planar top sections 55 of modular springs 16 and retain the planar top sections of the modules against lateral movement relative to the grid.

The first plurality of spaced parallel grid wires 40 are not spaced evenly apart, since grid wires 80 and 84 must be close enough to lock with the snap-fit sections of each modular spring 16. Grid wires from the second plurality of spaced parallel grid wires 42 are spaced evenly apart.

While we have described only one embodiment of our invention, persons skilled in the art to which it applies will readily appreciate numerous changes and modifications which may be made without departing from the spirit of my invention. Therefore, we do not intend to be limited except by the scope of the following claims.

We claim:

1. A foundation unit, comprising:

a) a frame;

b) a planar top portion spaced above said frame, and comprising a first plurality of spaced parallel grid wires and a second plurality of spaced parallel grid wires lying perpendicular to and connected to said first plurality of spaced parallel grid wires;

c) a plurality of modular springs extending between said planar top portion and said frame, each said modular spring comprising two vertical leg sections and a top planar section, said top planar section comprising a centermost longitudinal section and two longitudinal end sections, each said longitudinal end section being generally parallel to and offset from said centermost longitudinal section and being connected thereto by a transverse straight portion, each said longitudinal end section being connected to one of said vertical leg sections, each said vertical leg section being connected to said frame; and d) snap-fit means securing said modular springs to said planar top portion, said snap-fit means comprising a first parallel grid wire from said first plurality of spaced parallel grid wires extending over both transverse straight portions of said modular spring, a second parallel grid wire from said first plurality of spaced parallel grid wires extending under both transverse straight portions of said modular spring, and a pair of parallel grid wires from said second plurality of spaced parallel grid wires, wherein one of said pair of parallel grid wires extends over said one of said longitudinal end sections of said modular spring and another of said pair of parallel grid wires extends over another of said longitudinal end sections of said modular spring.

2. The foundation unit of claim 1 wherein said first plurality of spaced parallel grid wires are connected to said second plurality of spaced parallel grid wires by welding.

3. The foundation unit of claim 1 wherein each said parallel grid wire from said first plurality of spaced parallel grid wires is crimped at each point where said parallel grid wire crosses said transverse straight portion of said modular spring, such that said planar top portion lies substantially in a plane defined by said planar top sections of said modular springs.

4. A box spring unit comprising:

a) a rectangular frame;

b) a planar top portion spaced above said frame, and comprising a first plurality of spaced parallel grid wires and a second plurality of spaced parallel grid wires lying perpendicular to and connected to said first plurality of spaced parallel grid wires;

c) a plurality of modular springs extending between said planar top portion and said frame, each said modular spring comprising two vertical leg sections and a planar top section, said planar top section comprising a centermost longitudinal section and two longitudinal end sections, each said longitudinal end section being generally parallel to and offset from said centermost longitudinal section and being connected thereto by a transverse straight portion, each said longitudinal end section being connected to one of said vertical leg sections, each said vertical leg section being connected to said frame;

d) snap-fit means securing said modular springs to said planar top portion, said snap-fit means comprising a first parallel grid wire from said first plurality of spaced parallel grid wires extending over both transverse straight portions of said modular spring, a second parallel grid wire from said first plurality of spaced parallel grid wires extending under both transverse straight portions of said modular spring, and a pair of parallel grid wires from said second plurality of spaced parallel grid wires, wherein one of said pair of parallel grid wires extends over one of said longitudinal end sections of said modular spring and another of said pair of parallel grid wires extends over another of said longitudinal end sections of said modular spring;

e) a pad overlying said planar top portion; and f) a fabric cover covering said pad, said planar top portion and said modular springs.

5. The box spring unit of claim 4 wherein said first plurality of spaced parallel grid wires are connected to said second plurality of spaced parallel grid wires by welding.

6. The box spring unit of claim 4, wherein each said parallel grid wire from said first plurality of spaced parallel grid wires is crimped at each point where said parallel grid wire crosses said transverse straight portion of said modular spring, such that said planar top portion lies substantially in a plane defined by said planar top sections of said modular springs.

* * * * *

UNITED STATES PATENT AND TRADEMARK OFFICE

CERTIFICATE OF CORRECTION

PATENT NO. : 5,142,716

DATED : September 1, 1992

INVENTOR(S) : Steven E. Ogle and Danny L. Wylie

It is certified that error appears in the above-identified patent and that said Letters Patent is hereby corrected as shown below:

In column 1, line 58, "snap-it" should be --snap-fit--.

In column 2, line 29, please insert --underlying-- before the word "structure".

Signed and Sealed this

Second Day of November, 1993

*Attest:*

BRUCE LEHMAN

*Attesting Officer*

*Commissioner of Patents and Trademarks*